US007478549B2

(12) United States Patent
Ou et al.

(10) Patent No.: US 7,478,549 B2
(45) Date of Patent: Jan. 20, 2009

(54) SURFACE TREATMENT APPARATUS FOR PLANISHING METAL SURFACES

(75) Inventors: Chun-Nan Ou, Taipei Hsien (TW); Rong-Mou Bao, Shenzhen (CN); Cheng-Bin Su, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/614,993

(22) Filed: Dec. 22, 2006

(65) Prior Publication Data

US 2007/0240484 A1 Oct. 18, 2007

(51) Int. Cl.
*B21H 7/00* (2006.01)
*B21D 7/02* (2006.01)

(52) U.S. Cl. ..... 72/214; 72/207

(58) Field of Classification Search ..... 72/75, 72/112, 190, 214, 220, 207; 29/90.01, 243.58
See application file for complete search history.

(56) References Cited

U.S. PATENT DOCUMENTS 3,564,189 A * 2/1971 Rhodes ..... 219/83
7,127,927 B2 10/2006 Chung et al.

* cited by examiner

*Primary Examiner*—Dana Ross
*Assistant Examiner*—Teresa Bonk
(74) *Attorney, Agent, or Firm*—Wei Te Chung

(57) ABSTRACT

A surface treatment apparatus (100) comprises a transporting device (20), a planishing device (30) and a driving device (10). The transporting device comprises a base (21). The base comprises a front portion (212), a rear portion (214), and a pair of parallel middle portions (216) each comprising a slideway, which defines an opening therein. The base still comprising a sliding block (26) received in the opening (218), with two sides of the sliding block respectively slidably received in the slideways in the pair of middle portions. The planishing device comprises a pair of mounting blocks (32) fixed on the sliding block, at least one axle (34) fixed between the mounting blocks, and at least one wheels (342) fixed on the axle. The driving device is used for driving the sliding block to slide in the opening.

13 Claims, 5 Drawing Sheets

SURFACE TREATMENT APPARATUS FOR PLANISHING METAL SURFACES

BACKGROUND OF THE INVENTION

1. Field of the Invention

The present invention pertains to a surface treatment apparatus, and particularly to an apparatus for planishing metal surfaces.

2. Description of Related Art

In machining, stamping presses are usually applied on sheet metal. During a stamping procedure, sheet metal may have sharp or uneven edges after stamping. Therefore, some bent edges are usually formed at these uneven edges of the sheet metal so that the sheet metal can become more aesthetic and safer to be further used.

Usually, such bent edges of the sheet metal are made by a punching machine using a method of punch crushing so that surfaces of the sheet metal can be punched to be smooth even though the edges are bent. However, this often results in the surface being abraded because of sliding friction between the punch and the sheet metal.

Therefore, a heretofore unaddressed need exists in the industry to overcome the aforementioned deficiencies and inadequacies.

SUMMARY OF THE INVENTION

In an exemplary embodiment, a surface treatment apparatus comprises a transporting device, a planishing device, and a driving device. The transporting device comprises a base. The base comprises a front portion, a rear portion, and a pair of parallel middle portions each comprising a slideway. The front portion, the rear portion, and the pair of parallel middle portions cooperatively define an opening therein. The base further comprising a sliding block received in the opening, with two sides of the sliding block respectively slidably received in the slideways in the pair of middle portions. The planishing device comprises a pair of mounting blocks fixed on the sliding block, at least one axle fixed between the mounting blocks, and at least one wheel fixed on the axle. The driving device is used for driving the sliding block to slide in the opening.

Other advantages and novel features will become more apparent from the following detailed description when taken in conjunction with the accompanying drawings, in which:

DETAILED DESCRIPTION OF THE INVENTION

Figure 1:
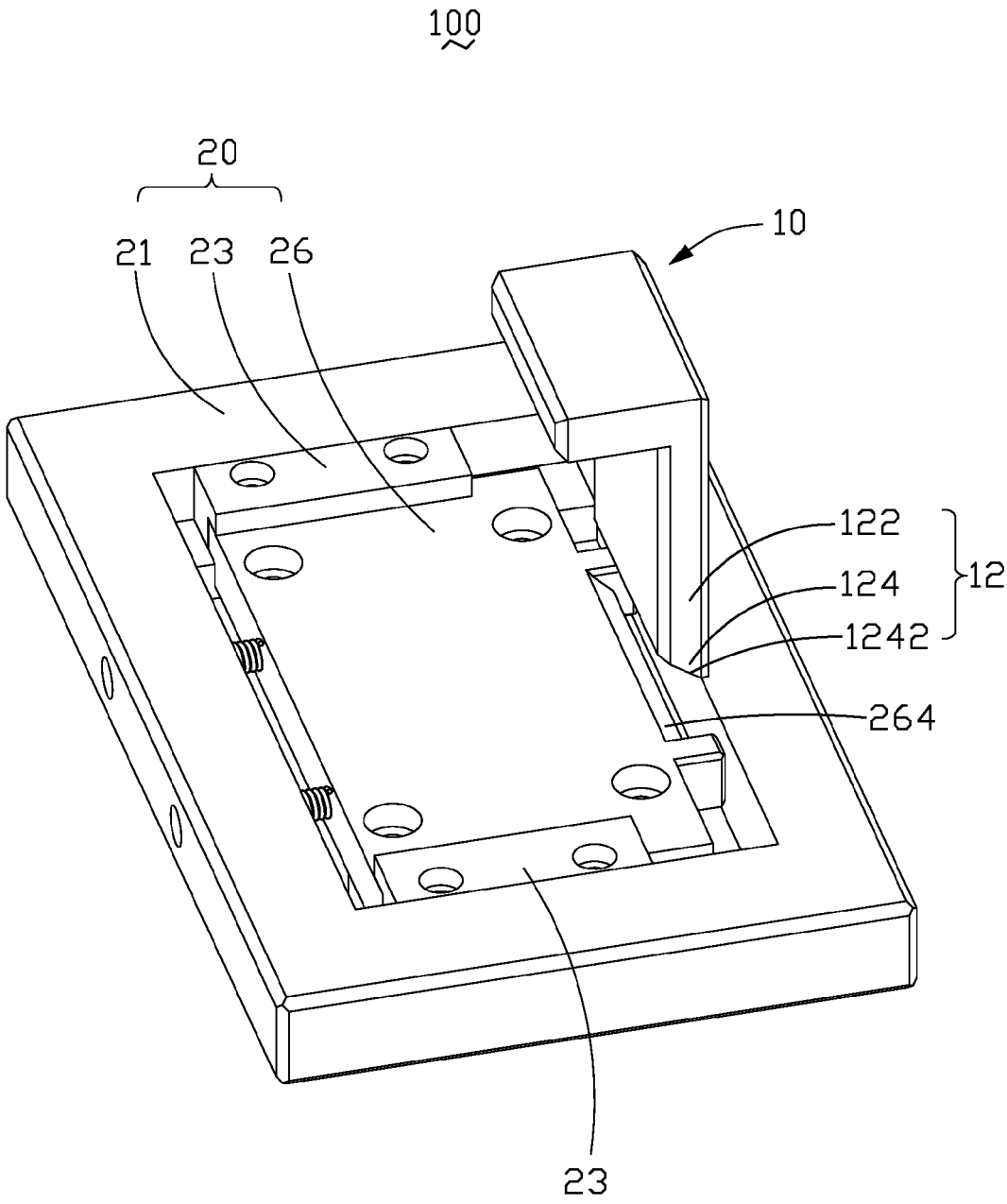
FIG. 1 is an assembled view of a surface treatment apparatus of an exemplary embodiment of the present invention, the surface treatment apparatus comprising a driving device, and a transporting device, the transporting device comprising a base.

Referring to FIG. 1, a surface treatment apparatus 100 of an exemplary embodiment of the present invention is shown.

The surface treatment apparatus 100 comprises a driving device 10, and a transporting device 20.

The driving device 10 comprises a rectangular driving block 12 desposed above the transporting device 20. The driving block 12 comprises a beveled edge 1242 formed at a lower edge thereof. In the exemplary embodiment, the driving block 12 can only move perpendicularly relative to the transporting device 20.

Figure 3:
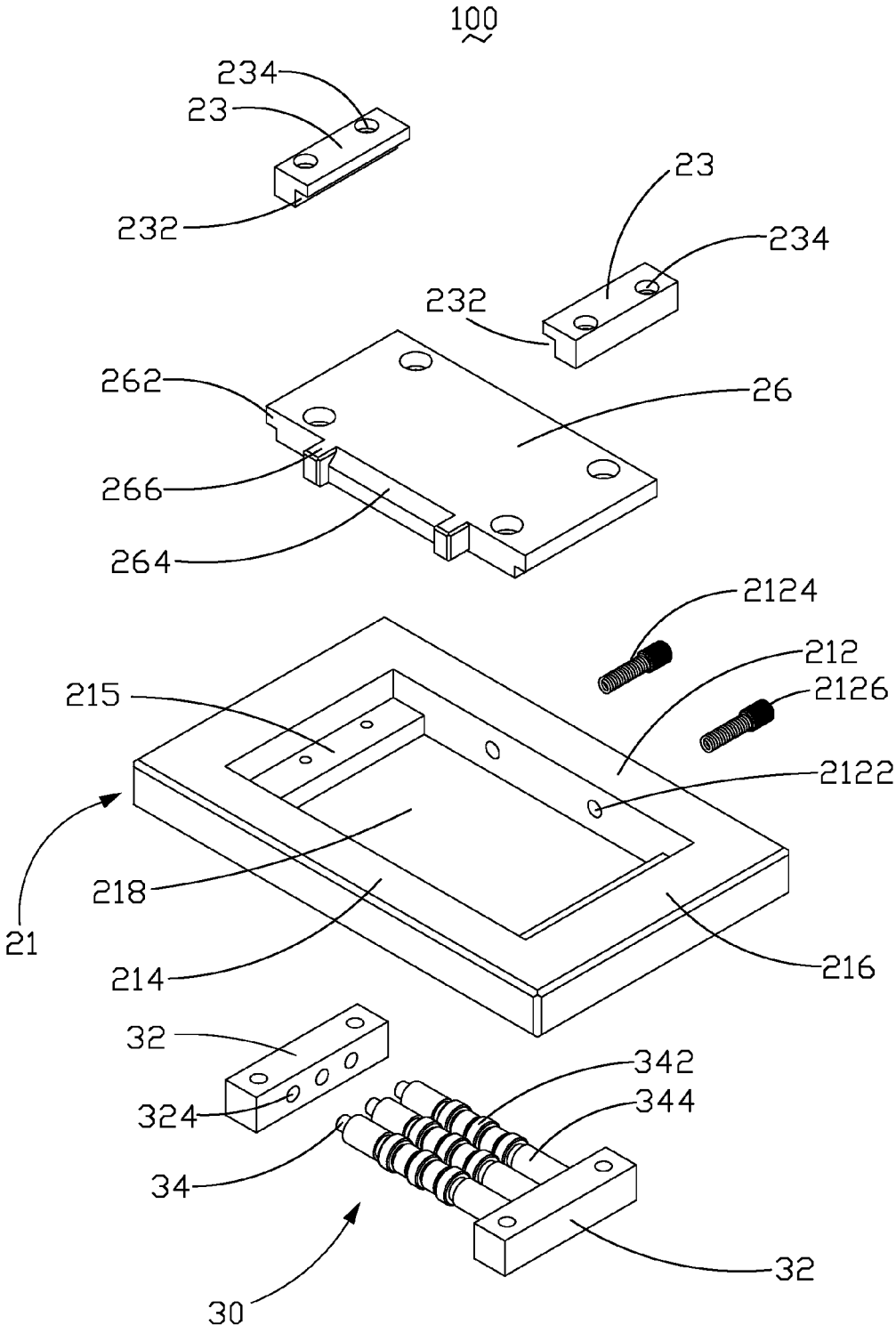
FIG. 3 is an exploded, perspective view of the surface treatment apparatus of the present invention.

Referring also to FIG. 3, the transporting device 20 comprises a rectangular base 21 having a rectangular opening 218 in a middle thereof, and a sliding block 26. The base 21 comprises a front portion 212, a rear portion 214 parallel to the front portion 212, and two parallel middle portions 216 each connecting with the front portion 212 and the rear portion 214. The opening 218 is surrounded by the front portion 212, the rear portion 214, and the middle portions 216.

Each of the two middle portions 216 comprises a supporting board 215 formed on a lower portion of a side thereof and located in the opening 218. Ends of each supporting board 215 respectively contact with the front portion 212 and the rear portion 214 of the base 21.

The sliding block 26 comprises two flanges 262 corresponding to the two supporting boards 215, which are respectively formed on two opposite ends of the sliding block 26. The sliding block 26 further comprises a pair of projecting portions 266 protruding towards the rear portion 214 of the base 21, and an inclined portion 264 formed between the two projecting portions 266.

Figure 2:
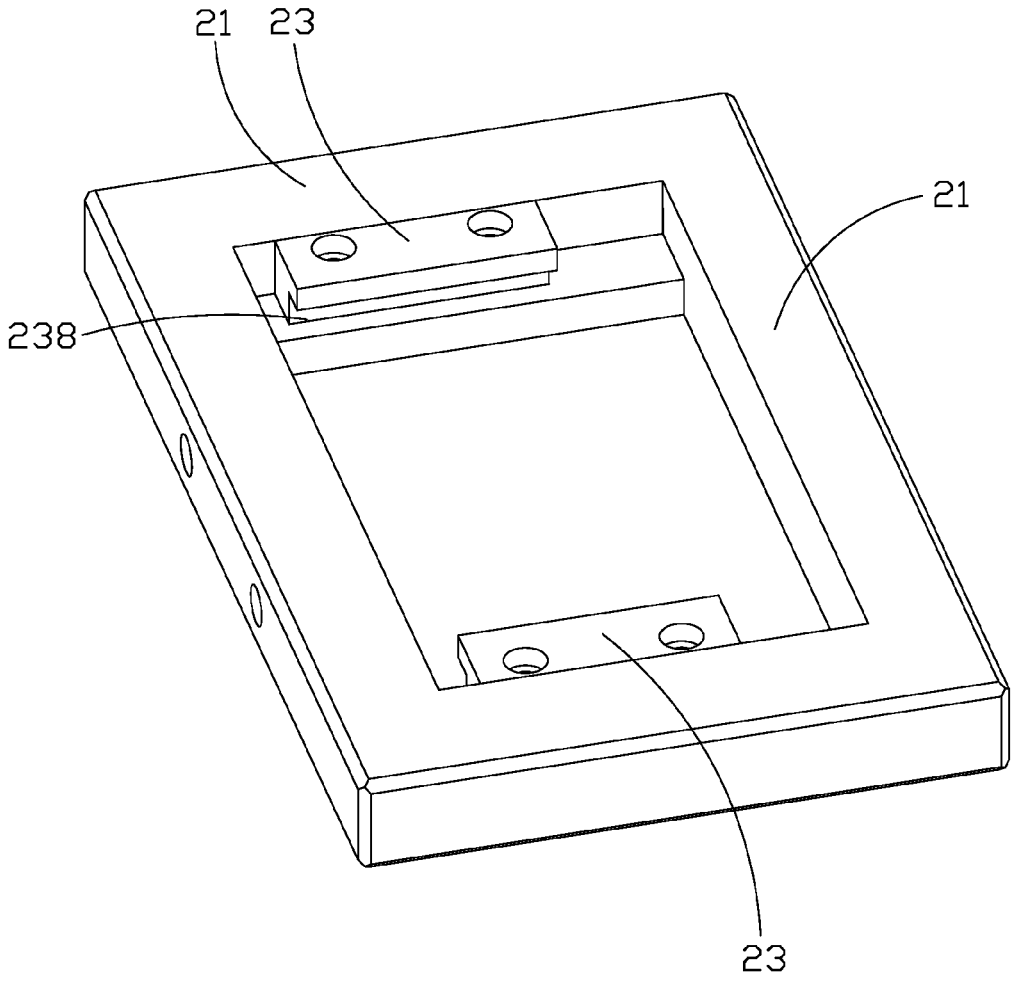
FIG. 2 is an assembled view of the base of the transporting device.

Referring also to FIG. 2, The base 21 further comprises two pressing blocks 23 respectively fixed on the two supporting boards 215 by a plurality of bolts (not shown). Each of the pressing blocks 23 comprises a cutout 232 at a lower edge thereof, and the cutouts 232 and the supporting boards 215 cooperatively form a pair of opposite slots to receive the two flanges 262 of the sliding block 26 therein in assembly. That is, the pressing blocks 23 and the supporting boards 215 cooperatively form a pair of slideways 238 on the middle portions 216 to slidably receive the sliding block 26 in the opening 218.

Figure 4:
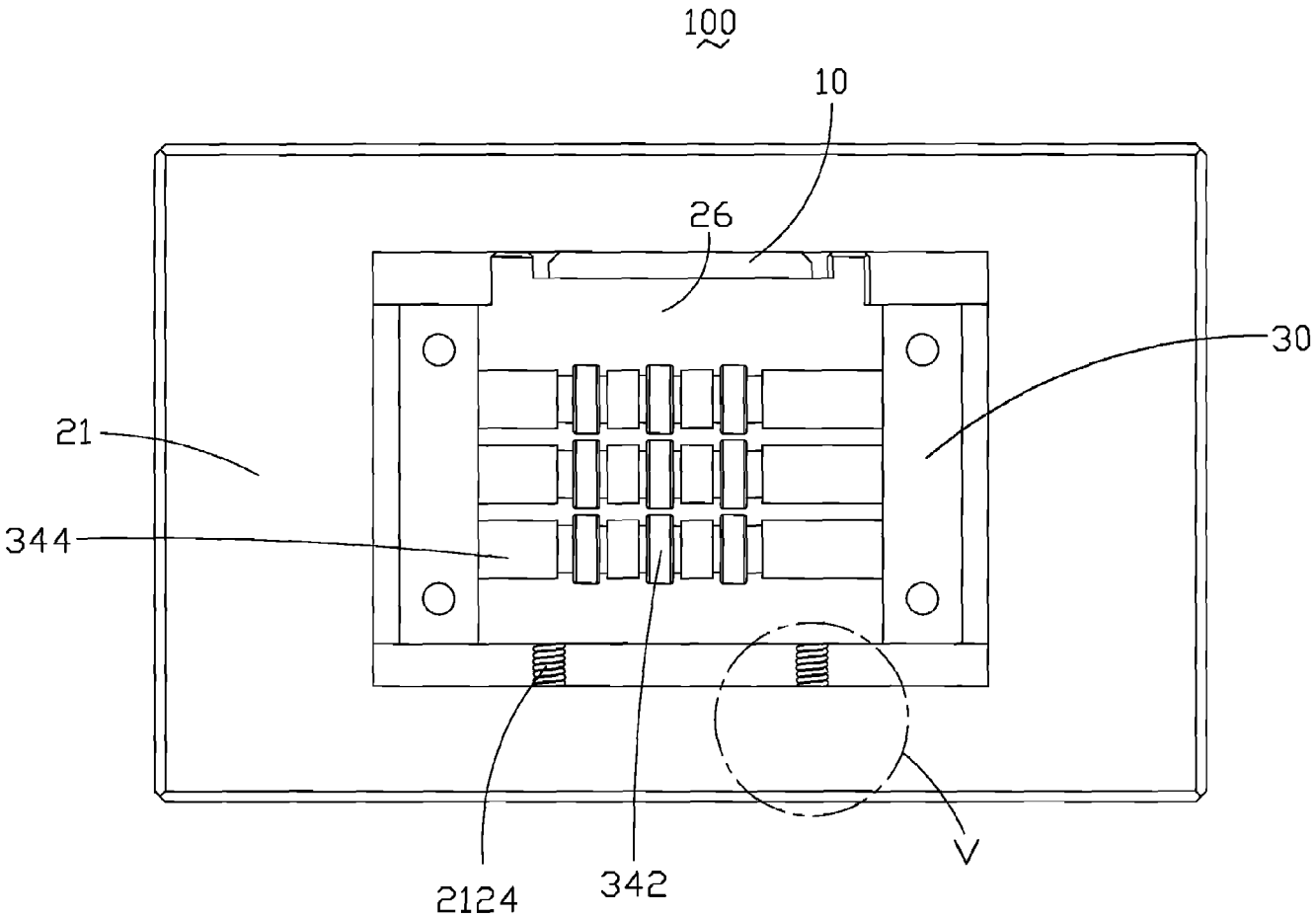
FIG. 4 is a bottom view of the surface treatment apparatus of FIG. 1.
Figure 5:
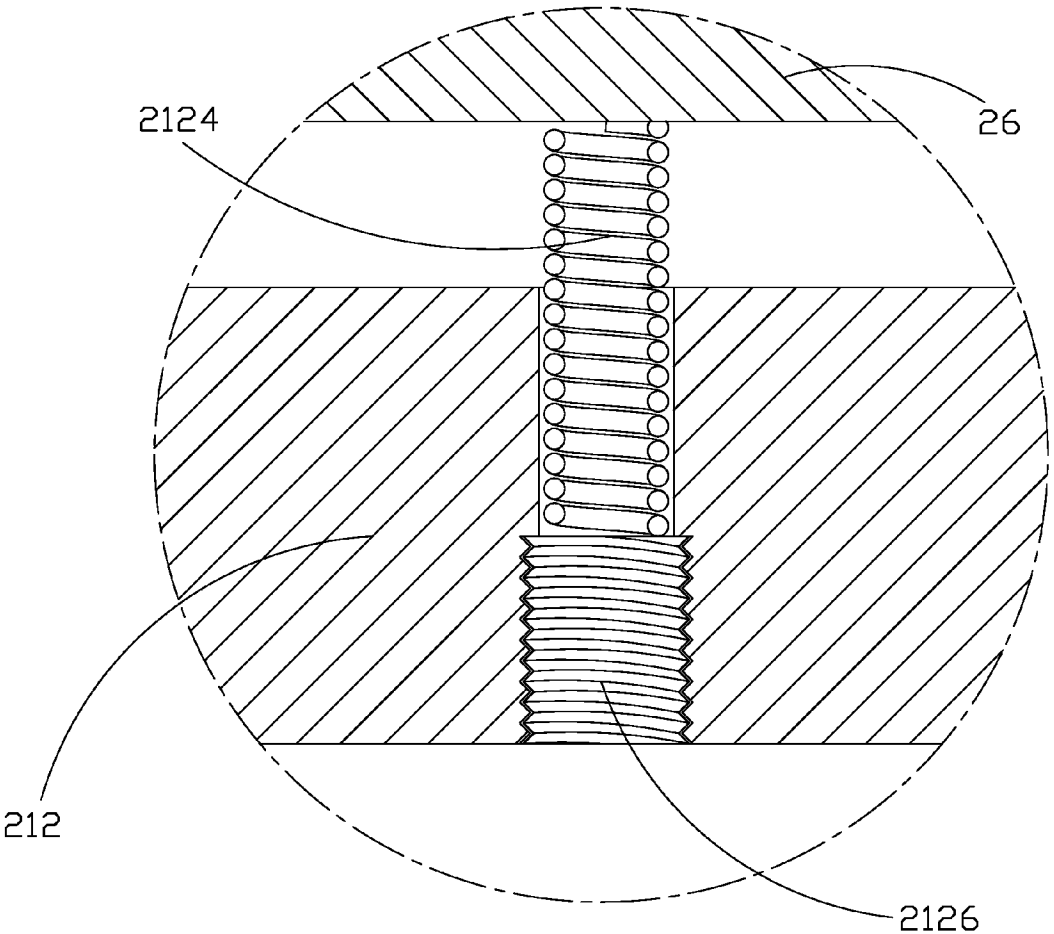
FIG. 5 is an enlarged cross-sectional view of a circled portion IV in FIG. 3.

Referring also to FIG. 4 and FIG. 5, the front portion 212 of the base 21 defines two fixing holes 2122 communicating with the opening 218. The fixing holes 2122 are through holes, and an end of each of the fixing holes 2122 away from the opening 218, is threaded. The base 21 further comprises two threaded stopples 2126. The two stopples 2126 are screwed into the corresponding threaded ends of the fixing holes 2122. The base 21 further comprises two springs 2124. Each of the two springs 2124 is partly received in one of the two fixing holes 2122, with an end of the each of the two springs 2124 contacting with the corresponding stopple 2126, and the other end abutting against the sliding block 26.

The surface treatment apparatus 100 further comprises a planishing device 30. The planishing device 30 comprises a pair of opposite mounting blocks 32 fixed on a bottom surface of the sliding block 26. The two mounting blocks 32 each comprise a plurality of opposite mounting holes 324. A plurality of axles 34 is fixed between the two mounting blocks 32 with two ends of each of the axles 34 respectively received in the corresponding mounting holes 324. The planishing device 30 further comprises a plurality of sleeves 344 fixed on each of the axles 34, and a plurality of wheels 342 respectively fixed between every two adjacent sleeves 344. The wheels 342 are used for rolling surfaces of sheet metal.

In assembly, the driving block 12 is positioned above the inclined portion 264 of the sliding block 26. The sliding block 26 is positioned in the opening 218, with two flanges 262 respectively disposed on the two supporting boards 215.

Then, the two pressing blocks 23 are respectively fixed on the supporting boards 215, with the two flanges 262 respectively received in the slots cooperatively formed by the cutout 232 of the pressing blocks 23 and the supporting boards 215. The two springs 2124, partly received in the fixing holes 2122 in the front portion 212 of the base 21, abut against the sliding block 26. And the planishing device 30 is fixed on the bottom of the sliding block 26.

In use, first, a sheet metal is disposed under the surface treatment apparatus 100, and on a path of the wheels 342 where the sliding block 26 is driven to slide in the opening 218.

Next, the driving block 12 is pushed down. Since the beveled edge 1242 of the driving block 12 contacts the inclined portion 264, the sliding blocks 26 are pushed to slide along the supporting boards 215 by the driving block 12, with the wheels 342 rolling over the surface of the metal sheet. During this process, the two springs 2124 are compressed.

After rolling the sheet metal, the driving block 12 is raised, allowing the springs 2124 to push the sliding block 26 back until the two projecting portions 266 of the sliding block 26 abut against the rear portion 214. At this time, the springs 2124 are decompressed.

During rolling of the sheet metal, the surface of the sheet metal is not easily abraded because friction between the wheels 342 and the surface of the sheet metal is a rolling friction. Further, speed of the driving block is controlled to prevent damage caused by the sliding block 26 striking the sheet metal.

While the exemplary embodiment has been described above, it should be understood that it has been presented by way of example only and not by way of limitation. Thus the breadth and scope of the present invention should not be limited by the above-described exemplary embodiment, but should be defined only in accordance with the following claims and their equivalents.

What is claimed is:

1. A surface treatment apparatus for planishing metal surfaces, comprising:

a transporting device, comprising a base, the base comprising a front portion, a rear portion, a pair of parallel middle portions each comprising a slideway, the front portion, the rear portion, and the pair of parallel middle portions cooperatively defining an opening therein, and a sliding block received in the opening, two ends of the sliding block respectively slidably received in the slideways in the pair of middle portions;

a planishing device, comprising a pair of mounting blocks fixed on the sliding block, at least one axle rotatably installed between the mounting blocks, with at least one wheel fixed thereon; and a driving device, for driving the sliding block to slide in the opening.

2. The surface treatment apparatus as claimed in claim 1, wherein the sliding block comprising two flanges formed on the two ends of the sliding block.

3. The surface treatment apparatus as claimed in claim 1, wherein each of the slideways comprises a supporting board received in the opening, and the two ends of the sliding block are slidably positioned on the supporting boards.

4. The surface treatment apparatus as claimed in claim 3, wherein the slideways further comprise two pressing blocks respectively fixed on the two supporting boards, each of the pressing blocks comprising a cutout adjacent the corresponding supporting board.

5. The surface treatment apparatus as claimed in claim 1, wherein the driving device comprises a driving block for driving the sliding block to slide along the slideway in the opening.

6. The surface treatment apparatus as claimed in claim 5, wherein the driving block comprises a beveled edge at one edge thereof the, sliding block further comprises an inclined portion corresponding to the beveled edge.

7. The surface treatment apparatus as claimed in claim 1, wherein the front portion of the base comprises at least a fixing hole communicating with the opening, and at least one spring is partly received in the fixing hole, with an end abutting against the sliding block.

8. The surface treatment apparatus as claimed in claim 1, wherein the planishing device further comprises a plurality of sleeves fixed on the at least one axle, and the at least one wheel is respectively fixed between two adjacent sleeves.

9. An apparatus for evening surfaces of metal sheets, comprising:

a transporting device extending along a surface above a metal sheet to be evened, and defining a sliding block therein, said sliding block movable along said extending surface of said transporting device;

a planishing device attachable to said sliding block and comprising at least one axle rotatably installable therein with at least one wheel fixed thereon; and a driving device disposed next to said transporting device and movable toward said transporting device, said driving device engagable with said sliding block after said driving device reaches said transporting device so as to trigger movement of said sliding block along said extending surface of said transporting device in order for driving said at least one wheel of said planishing device to roll over said metal sheet to be evened.

10. The apparatus as claimed in claim 9, wherein said driving device comprises a beveled edge at a side thereof facing said transporting device, and said sliding block comprises an inclined portion corresponding to said beveled edge for engagement between said driving device and said sliding block.

11. An apparatus for evening surfaces of metal sheets, comprising:

a transporting device extending along a surface above a metal sheet to be evened, and defining a sliding block therein, said sliding block movable along said surface said transporting device extends;

a planishing device attachable to said sliding block and reachable to said metal sheet, said planishing device comprising at least one wheel to roll over said metal sheet to be evened when said planishing device is moved together with said sliding block along said surface; and a driving device disposed next to said transporting device and perpendicularly movable toward said transporting device to move said sliding block along said surface by means of reachably engaging with said sliding block.

12. The apparatus as claimed in claim 11, wherein said driving device comprises a beveled edge at a side thereof facing said transporting device, and said sliding block comprises inclined portion corresponding to said beveled edge for engagement between said driving device and said sliding block.

13. The apparatus as claimed in claim 9, wherein said driving device is perpendicularly movable toward said transporting device to engage with said sliding block.

* * * * *